United States Patent [19]

Stansbury, Jr.

[11] 4,324,362

[45] Apr. 13, 1982

[54] POCKET ATOMIZER

[75] Inventor: Benjamin H. Stansbury, Jr., Beverly Hills, Calif.

[73] Assignee: Pocket Supportable Atomizer Device Trust

[21] Appl. No.: 127,903

[22] Filed: Mar. 6, 1979

[51] Int. Cl.[3] ..... B05B 1/00

[52] U.S. Cl. ..... 239/211; 239/331

[58] Field of Search ..... 239/211, 329, 331, 333; 222/464, 402.24

[56] References Cited

U.S. PATENT DOCUMENTS

| | | | |
|---|---|---|---|
| 2,069,156 | 1/1937 | Bernhardt | 239/331 X |
| 2,561,570 | 7/1951 | Hadden | 239/331 |
| 3,223,293 | 12/1965 | Seaquist | 222/464 X |
| 3,601,315 | 8/1971 | Montalbo | 239/211 |
| 4,228,931 | 10/1980 | Ruscitti et al. | 239/333 X |

*Primary Examiner*—Robert B. Reeves
*Assistant Examiner*—Gene A. Church
*Attorney, Agent, or Firm*—Brown & Martin

[57] ABSTRACT

A pocket atomizer that can be primed to hold liquid such as tear gas, in position for immediate discharge upon first application of its plunger. The atomizer includes a hollow piston having a hollow piston rod. The piston is movable up and down within a pump cylinder to force liquid up through the hollow piston rod. A check valve is located within the lower end of the hollow piston rod, and an orifice is located in the upper end of the hollow piston rod for discharging the pumped liquid. A capillary tube located within the hollow piston rod has an upper end coupled to the orifice for preventing liquid from draining therefrom between uses and thereby eliminates the necessity of priming the atomizer between uses. The lower end of the capillary tube terminates some distance above the check valve to define a chamber above the check valve. The check valve includes a valve seat and a ball of greater diameter than the capillary tube and of sufficient mass to seat in the valve seat when the piston is moved up. The chamber is of sufficient diameter and depth to enable the ball to move off the valve seat to enable liquid to be pumped up through the check valve and into the capillary tube when the piston is moved down. The check valve is of greater diameter than the capillary tube to enable a large quantity of liquid to be discharged through the orifice upon a single downward movement of the piston.

7 Claims, 4 Drawing Figures

POCKET ATOMIZER

BACKGROUND OF THE INVENTION

This invention relates to pocket atomizers of the type disclosed in U.S. Pat. No. 3,601,315 which issued on Aug. 24, 1971, to G. H. Montalbo for a "Pocket Supportable Atomizer Device". The pocket atomizer disclosed in U.S. Pat. No. 3,601,315 has an elongated barrel which forms a reservoir for the liquid to be atomized. A pump cylinder is enclosed within the reservoir and is coupled therto by a first check valve. A hollow piston with a hollow piston rod is axially slidable within the pump cylinder to force liquid upwardly through the hollow piston rod and out an atomizing orifice on the top of the piston rod. A second check valve is mounted within the hollow piston rod. The piston and piston rod are spring biased to their upward position.

With the above described type of prior art pocket atomizer, the liquid to be atomized drains from the hollow piston rod between uses, and one or more priming strokes are required to fill the piston rod with liquid before liquid can be dispensed from the atomizing orifice.

The principal object of this invention is to provide a pocket atomizer which will not require priming strokes between uses. This is particularly important when the atomizer must discharge liquid immediately, such as when it is used for discharging tear gas in self defense.

Other objects and advantages of the invention will be apparent from the detailed description herein.

SUMMARY OF THE INVENTION

In accordance with this invention, the necessity of priming a pocket atomizer between uses is eliminated by placing a capillary tube in the hollow piston rod of the pocket atomizer and sealing the space between the capillary tube and the hollow piston rod so that the liquid to be atomized is forced to flow through the capillary tube. The upper end of the capillary tube is coupled to the atomizing orifice. The capillary forces within the capillary tube prevent liquid from draining therefrom between uses, and thus eliminates the necessity of priming the atomizer between uses. A check valve is located within the lower end of the hollow piston rod. The lower end of the capillary tube terminates some distance above the check valve to define a chamber above the check valve. The check valve includes a valve seat and a ball of greater diameter than the capillary tube and of sufficient mass to seat in the valve seat when the piston is moved up. The chamber is of sufficient diameter and depth to enable the ball to move off of the valve seat to enable liquid to be pumped up through the check valve and into the capillary tube when the piston is moved down. The space between the interior of the hollow piston road and the capillary tube is sealed so that liquid flows only through the capillary tube when pumped up through the check valve.

Preferably, the check valve is of greater diameter than the capillary tube to enable a large quantity of liquid to be discharged through the orifice upon a single downward movement of the piston.

DESCRIPTION OF THE PREFERRED EMBODIMENT

Figure 1:
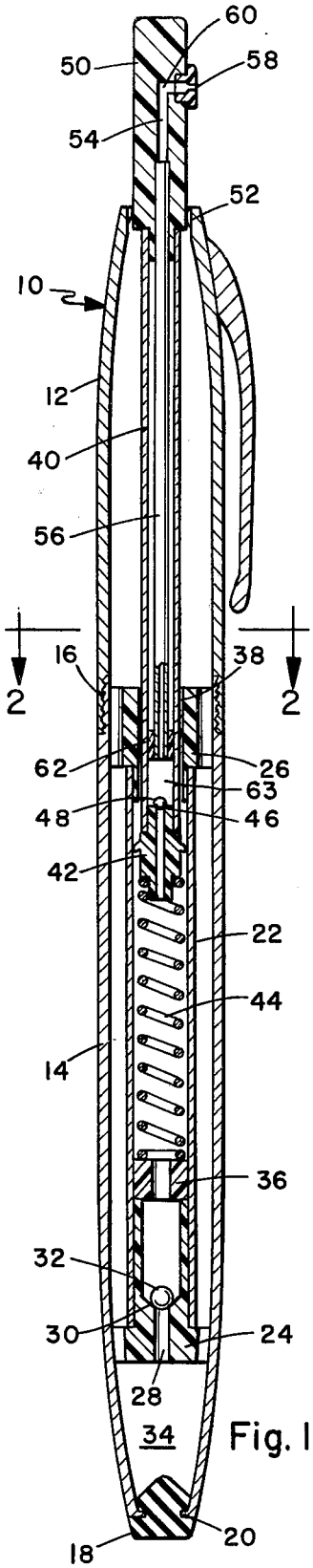
FIG. 1 is a longitudinal sectional view of the preferred embodiment of the invention.
Figure 2:
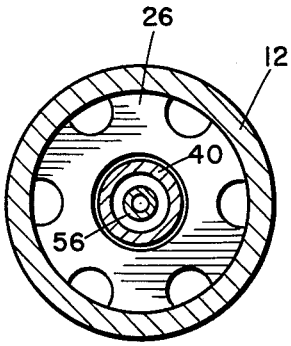
FIG. 2 is an enlarged cross-sectional view taken on the line 2—2 of FIG. 1.

Referring to FIGS. 1 and 2, the preferred embodiment of the invention is housed in a barrel 10 which is made of an upper barrel member 12 and a lower barrel member 14 which are joined together by screw threads 16. The barrel 10 serves as a reservoir for the fluid to be atomized, which can be tear gas, a perfume or any other suitable liquid. The bottom of the lower barrel member 14 is open and is closed by a removable plastic plug 18 which is shaped to lock on a flange 20 on the bottom of the lower barrel member 14 to prevent it from being dislodged by fluid pressure generated by pump action of the device.

The pump action includes a pump cylinder 22 which is held in spaced relation inside the lower barrel member 14 by two perforated spacers or spiders 24 and 26. The lower spacer 24 has an axial opening 28 and a valve seat 30 which interacts with a ball 32 to form a check valve which couples the interior of the pump cylinder 22 to a reservoir 34 formed by the barrel member 10. The lower spacer 24 extends upwardly within the pump cylinder 22 and supports a third spacer 36 having an axial opening to permit passage of fluid.

The upper spacer 26 has an axial opening 38 in which a hollow piston rod 40 is slidably mounted. The hollow piston rod 40 is attached to a hollow piston 42 which is slidable within pump cylinder 22. The piston 42 is urged upwardly by a spring 44 which extends between the piston 42 and the spacer 36. The upper end of the piston 42 is shaped to form a valve seat 46 which interacts with a ball 48 to form a second check valve.

A plunger 50 is attached to the top of the hollow piston rod 40 and slides in an axial opening 52 in the top of the upper barrel member 12. The plunger 50 contains an axial duct 54 which is coupled on its lower end to a capillary tube 56 through which liquid is pumped to an orifice 58 in the center portion of the plunger 50. The orifice 58 is coupled to the axial duct 54 by a short transverse duct 60.

The capillary tube 56 extends within the hollow interior of the piston rod 40 and terminates at a sealing plug 62 which is positioned some distance above the check valve 46, 48 to define a chamber 63. The sealing plug 62 seals the space between the capillary tube 56 and the hollow piston rod 40 and restricts the flow of liquid to the capillary tube 56. The capillary tube 56 has a small enough inside diameter to prevent liquid from flowing downwardly therethrough under the force of gravity. In other words, the capillary attraction force within the capillary tube 56 is greater than the weight of the liquid enclosed therewithin. The inside diameter of the capillary tube 56 depends upon the viscosity of liquid to be atomized but can be easily determined by well known prior art techniques.

The ball 48 is of greater diameter than the capillary tube 56 and of sufficient mass to seat in the valve seat 46 when the piston 42 is moved up. The chamber 63 is of sufficient diameter and depth to enable the ball 48 to move off of the valve seat 46 to enable liquid to be pumped up through the second check valve and into the capillary tube 56 when the piston 42 is moved down. The second check valve 46, 48 is of greater diameter than the capillary tube 56 to enable a large quantity of liquid to be discharged through the orifice 58 upon a single downward movement of the piston 42.

To operate the atomizer, it is first filled with fluid to be atomized through the bottom of the lower barrel member 14 by removing plug 18 and pouring the liquid in. After plug 18 is replaced, plunger 50 is depressed until liquid is pumped out of the orifice 58. Each depression of the plunger 50 moves the piston 42 downward against the force of the spring 44, causes the check valve 30, 32 to close, the check valve 46, 48 to close, and draws liquid from the reservoir 32 into the pumping cylinder 22. Once the atomizer has been initially primed, it does not have to be primed again between uses because the capillary forces within the capillary tube 56 prevent liquid from being drained therefrom between uses by the force of gravity.

Figure 4:
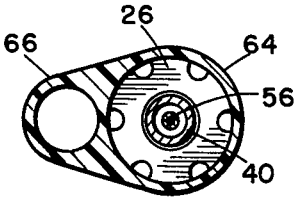
FIG. 4 is a cross sectional view taken on the line 4—4 of FIG. 3.
Figure 3:
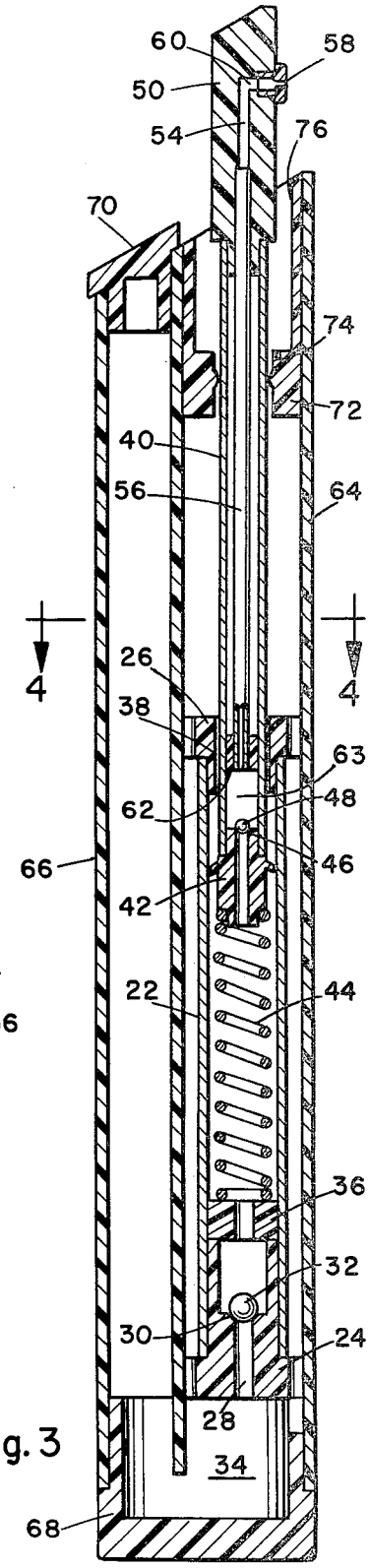
FIG. 3 is a longitudinal sectional view of an alternate embodiment of the invention.

FIGS. 3 and 4 shows an alternate embodiment with a larger capacity reservoir. In this embodiemnt, the housing is a unitary cylinder 64 with an adjacent auxiliary chamber 66 which forms an auxiliary reservoir for the fluid. Both the cylinder 64 and the chamber 66 are closed on the bottom end by plug 68. The chamber 66 is closed on its top by a removable plug 70. When the plug 70 is removed, liquid can be poured into the top of the chamber 66 and travels therefrom into the cylinder 64. A plug 72 on the upper end on the cylinder 64 has an axial opening 74 therein for the hollow piston rod 40 and has an axial recess 76 for receiving the plunger 50. The pump parts of this embodiment are the same as the pump parts described in connection with FIG. 1 and are numbered the same.

Having described my invention, I claim:

1. A pocket atomizer having an elongated barrel which forms a reservoir, a pump cylinder within said reservoir, a first check valve coupling the bottom of said pump cylinder to said reservoir, a hollow piston having a hollow piston rod, which piston is axially movable up and down within said pump cylinder to force liquid up the interior of said hollow piston rod, a second check valve within the lower end of said hollow piston rod, and an orifice in the upper end of said hollow piston rod for discharging the pumped liquid, characterized by a capillary tube within the interior of said hollow piston rod having an upper end coupled to said orifice for preventing liquid from draining therefrom between uses and thereby eliminating the necessity of priming the atomizer between uses, wherein the lower end of said capillary tube terminates some distance above said second check valve to define a chamber above said second check valve; and means sealing the space between the interior of said hollow piston rod and said capillary tube so that liquid flows only through said capillary tube when pumped up through said second check value;

wherein the second check valve includes a valve seat and a ball of greater diameter than said capillary tube and of sufficient mass to seat in said valve seat when said piston is moved up; and wherein said chamber is of sufficient diameter and depth to enable said ball to move up off of said valve seat to enable liquid to be pumped up through said second check valve and into said capillary tube when said piston is moved down.

2. The pocket atomizer defined in claim 1, also including:

a plunger on top of said hollow piston rod;

a duct in said plunger communicating with said capillary tube;

and said orifice being located in said plunger and being coupled to said duct.

3. The pocket atomizer defined in claim 2, wherein there is an opening in the top of said barrel that is demensioned to slidably receive said plunger.

4. The pocket atomizer defined in claim 1, also including an elongated auxiliary reservoir attached to said elongated barrel.

5. The pocket atomizer defined in claim 1, also including a removable plug in the bottom of said barrel for filling said barrel with liquid.

6. The pocket atomizer defined in claim 1, also including a pair of spacers for holding said pump cylinder in spaced relation within said barrel.

7. The pocket atomizer defined in claim 1, wherein the second check valve is of greater diameter than the capillary tube to enable a large quantity of liquid to be discharged through the orifice for a prolonged duration upon a single downward movement of the piston.

* * * * *